United States Patent [19]

Fatton

[11] 4,319,350

[45] Mar. 9, 1982

[54] ELECTRONIC WATCH

[75] Inventor: Jean-Claude Fatton, Le Landeron, Switzerland

[73] Assignee: Ebauches Electroniques S.A., Neuchatel, Switzerland

[21] Appl. No.: 151,779

[22] Filed: May 21, 1980

[30] Foreign Application Priority Data

Jun. 1, 1979 [CH] Switzerland ..... 513479

[51] Int. Cl.[3] ..... G04B 19/22; G04C 17/02

[52] U.S. Cl. ..... 368/22; 368/29; 368/240

[58] Field of Search ..... 368/21–27, 368/84, 69, 70, 242, 240, 28, 29

[56] References Cited

U.S. PATENT DOCUMENTS

| | | | |
|---|---|---|---|
| 3,653,204 | 4/1973 | Miwa | 58/42.5 |
| 3,757,509 | 9/1973 | Fujita | 368/70 |
| 3,911,665 | 10/1975 | Van Berkum | 368/69 X |
| 4,183,203 | 1/1980 | Maezawa et al. | 368/242 X |
| 4,196,582 | 4/1980 | Hersberger et al. | 368/70 |

FOREIGN PATENT DOCUMENTS 52-97764 8/1977 Japan .

*Primary Examiner*—Vit W. Miska

*Attorney, Agent, or Firm*—Silverman, Cass & Singer, Ltd.

[57] ABSTRACT

An electronic watch comprises two passive electro-optic display devices one of which provides a digital display and the other of which provides an analog display. In one operational mode, the analog display device displays the local time while the digital display device furnishes other information such as the days of the week and the dates, for example. In another operational mode, which is selected by means of a push-button, the analog display device comprises only one activated segment (constituted or formed of a ray) which is consequently visible, to indicate opposite a scale of the time zones which time zone is actually selected, the digital display device then indicating the time of the selected time zone. The selection of the time zone which is displayed by the digital display device is effected by means of another push-button.

5 Claims, 3 Drawing Figures

ELECTRONIC WATCH

BACKGROUND OF THE INVENTION

Field of the Invention

This invention relates to an electronic watch comprising two passive electro-optic display devices, one of these devices being able to display the time in an analog form and the other one furnishing digital information.

SUMMARY OF THE INVENTION

Such watches provide, due to their double mode of display, a large diversity of functions to be provided. The object of the present invention is to provide a supplementary possibility for the functions available with watches of this general character.

The various features of the invention will be apparent from the following description, drawings and claims, the scope of the invention not being limited to the drawings themselves as the drawings are only for the purpose of illustrating one way in which the principles of the invention can be applied. Other embodiments of the invention utilizing the same or equivalent principles may be used and structural changes may be made as desired by those skilled in the art without departing from the present invention and the purview of the appended claims.

DESCRIPTION OF THE PREFERRED EMBODIMENTS

The watch as illustrated, in this example an electronic wrist-watch generally designated by the reference 1, comprises two passive electro-optic display devices 2 and 3 each of a liquid crystal type. The display device 2 is a conventional display device, displaying digitally or numerically. Display device 2 has four digits, each composed of seven segments arranged in a figure "8" shape, with two supplementary segments enabling display of the first letters of the names of the days of the week.

Figure 1:
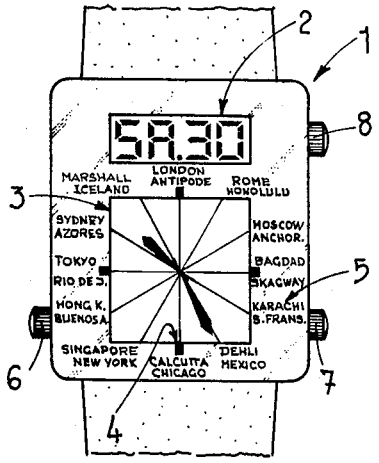
FIGS. 1 and 2 are plan views, respectively illustrating two different operational modes, of an electronic wrist-watch representing a preferred embodiment of the invention.

As a matter of fact, in the operational mode illustrated in FIG. 1, the first two digits serve for display of the two first letters of the names of the days of the week (Saturday in the example illustrated) while the last two digits serve for display of the dates of the month (the number thirty in the example as illustrated).

Considering now the display device 3, it comprises a passive electro-optic display cell of square shape comprising display segments arranged radially with respect to the center of the square. The display enables one or the other of radial segments, and possibly several thereof, to be rendered contrasted, and hence visible so that they then appear as the conventional hands of a watch, indicating the time with respect to hours graduations or indicia 4 on the upper face of the watch, around the cell 3. Thus, the time (hours, minutes, and possibly also seconds) is displayed in analog form, like the display produced by conventional hands, in spite of the fact that this time display is produced electro-optically.

The watch illustrated further comprises, for reasons which will be mentioned later, a scale 5 of the time zones, which are set out around the display cell 3, a push-button 6 enabling the operational mode of the watch to be selected, a push-button 7 enabling selection of the time zone the time of which is displayed by the display cell 2, and a push-button 8 operative to light an incandescent lamp 9 (FIG. 3) serving to illuminate the cell 2.

Figure 3:
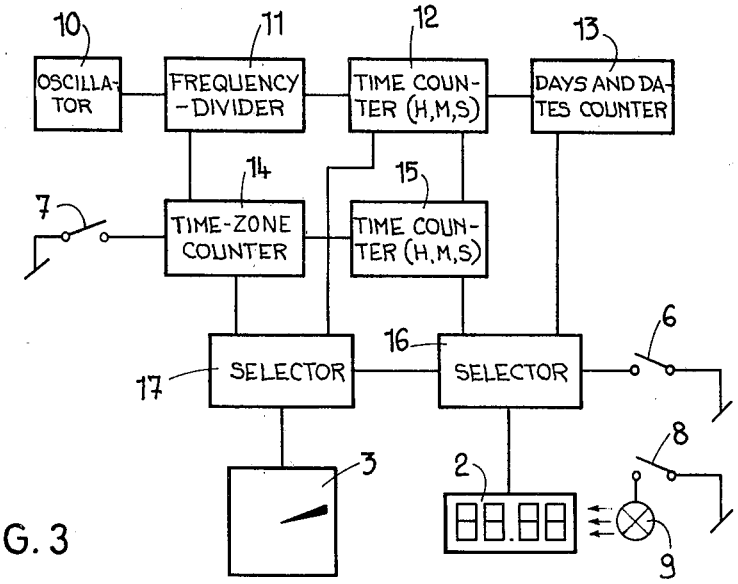
FIG. 3 is a block electronic circuit diagram of the preferred embodiment.

Concerning the electronic circuit illustrated in FIG. 3, it comprises an oscillator 10, a frequency-divider 11, a time counter 12 (hours, minutes and seconds), a days and dates counter 13, a zone counter 14, a second time counter (hours, minutes and seconds) 15, a selector 16 through which the digital display cell 2 is operated, and a selector 17 through which the analog display cell is operated.

Figure 2:
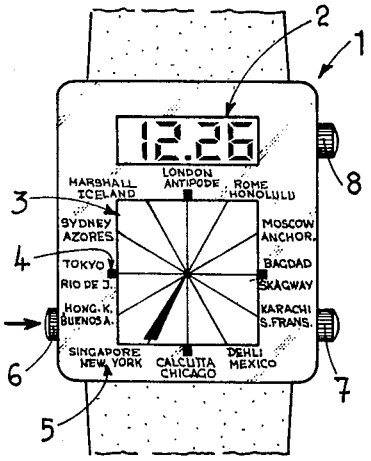

When the watch is operating in the mode previously disclosed, as illustrated in FIG. 1, the indications furnished by the hour counter 12 are fed to the display cell 3 through the intermediary of the selector 17. Simultaneously, the indications furnished by the days and dates counter 13 are sent to the display cell 2 through the intermediary of the selector 16. If the push-button 6 for selection of the operational mode of the watch is operated, the result is that the information of the hour counter 12 is sent to the cell 2 through the selector 17, but with this information being "corrected", in a manner described hereafter, by the counter 15. As concerns the display cell 3, it receives, through the intermediary of the selector 17, the information contained in the counter 14. Counter 14 is the time zone counter which counts the pulses which are sent thereto at each operation of the push-button 7 for selecting the time zone which is displayed. The activated segment of the display cell 3 then indicates, opposite the scale 5 of the time zone, the selected time zone (New York or Singapore in the example illustrated in FIG. 2, where it is 26 minutes past 12 o'clock). At each operation of the push-button 7 the activated segment of the cell 3 advances by one step. Simultaneously, the counter 15, which receives its information from the counter 12, has its count content incremented by one hour at each operation of the push-button 7, so that, when the watch is in the operational mode illustrated in FIG. 2, the time displayed by the cell 2 is leading or lagging by a round number of hours with respect to the time which would be displayed if the information were to come directly from the counter 12, without passing through the counter 15.

As a modification, the time of any new time zone, which has been selected by means of the push-button 7, can be transferred by a simple manipulation, for instance of two push-buttons simultaneously, such as push-buttons 7 and 8, onto the analog display by the cell 3. By this means the user of the watch when travelling, for example, can provide for the time of the place where he actually is to be displayed in analog form by the cell 3.

In the example illustrated, the digital display cell 2 displays the names of the days of the week and the dates, when the watch is in its first operational mode. It could, however, display other information such as dates and seconds, for example.

The push-button 6 could also serve to put into service more than two operations provided it is operated according to a specific code: for instance one shot for one operation, two shots for another one, etc.

The two display cells 2 and 3 can be entirely distinct from each other or constitute one and the same cell, or alternatively some of their elements may be common to the two cells, such as their plates, their polarizers or their electrodes, for example.

The illumination of the cell 2 can be of any type, for instance by means of an incandescent lamp 9 such as is described and illustrated or by a light-emitting diode. One could even provide a permanent lighting device ($\beta$-light), the push-button 8 being then omitted or serving another functions.

I claim:

1. An electronic watch for indicating time locally and time in one of a plurality of time zones, comprising:

time counter means for providing at least minute and hour information;

first passive electro-optic display means for indicating the provided time information in an analog form, the first display means being provided with fixed indicia indicating time and time zones, and a plurality of radial segments having positions arranged aligned with the indicia;

second passive electro-optic display means for indicating the provided time information in a digital form;

manually operable means for selecting a first operating mode of the watch for indicating time locally and a second operating mode of the watch for indicating time in one of the time zones; and selector means providing control information for selecting one time zone and retaining said control information, and means responsive to said control information for providing modified at least minute and hour information corresponding to the at least minute and hour information in said selected time zone;

so that in said first operating mode, said selector means control said first display means to display at least two radial segments having positions with respect to said indicia corresponding to said at least minute and hour information; and in said second operating mode, said selector means control said first display means to display one radial segment having a position corresponding to said selected time zone with respect to said indicia, and said second display means to display said modified at least minute and hour information.

2. The electronic watch as claimed in claim 1 wherein said time counter means comprise oscillator means for providing time pulses and means counting said time pulses for providing at least minute pulses and hour pulses;

said selector means comprise a first manually operable member for generating time zone control pulses when operated, and a time zone counter for counting time pulses in response to said time zone control pulses;

said means for providing modified at least minute and hour information adding said time pulses counted by said time zone counter to said at least minute and hour pulses for generating said modified at least minute and hour information; and said selector means comprise a second manually operable member and first and second selectors both responsive to said second member, said first selector applying said at least minute and hour information to said first display means when said second member controls said first operating mode, said first and second selectors respectively applying said time pulses counted by said time zone counter to said first display means and said modified minute and hour pulses to said second display means when said second member controls said second operating mode.

3. An electronic watch for indicating time locally and time in one of a plurality of time zones, comprising:

time counter means for providing at least minute and hour information;

first passive electro-optic display means for indicating the provided time information in an analog form, the first display means being provided with fixed indicia indicating time and time zones, and a plurality of radial segments having positions arranged aligned with the indicia;

second passive electro-optic display means for indicating the provided time information in a digital form;

manually operable means for selecting a first operating mode of the watch for indicating time locally, a second operating mode for digitally indicating time in one of said time zones, and a third operating mode for indicating time in one of said time zones in an analog form;

selector means for providing control information for selecting one time zone and retaining said control information, and means responsive to said control information for providing modified at least minute and hour information corresponding to the at least minute and hour information in said selected time zone;

so that in said first operating mode, said selector means control said first display means to display at least two radial segments having positions with respect to said indicia corresponding to said at least minute and hour information; in said second operating mode, said selector means control said first display means to display one radial segment having a position corresponding to said selected time zone with respect to said indicia, and said second display means to display said modified at least minute and hour information; and in said third operating mode, said selector means control said first display means to display at least two radial segments having positions corresponding to said modified at least minute and hour information with respect to said indicia.

4. The electronic watch as claimed in claims 1, 3, or 2, wherein said indicia for indicating time and said indicia for indicating time zones are the same.

5. The electronic time watch as claimed in claim 4, further including the names of a plurality of towns adjacent the corresponding time zone indicia.

* * * * *